United States Patent [19]

Riccio

[11] 4,061,252

[45] Dec. 6, 1977

[54] AEROSOL DISPENSER USING BUTANE PROPELLANT

[75] Inventor: Pasquale R. Riccio, Salem, N.H.

[73] Assignee: Ciba-Geigy Corporation, Ardsley, N.Y.

[21] Appl. No.: 665,313

[22] Filed: Mar. 9, 1976

[51] Int. Cl.[2] ..... B65D 83/14; F16K 31/58

[52] U.S. Cl. ..... 222/402.18; 222/402.24; 239/573; 239/579

[58] Field of Search ..... 239/308, 573, 579; 222/193, 402.18, 402.24, 402.21

[56] References Cited

U.S. PATENT DOCUMENTS

| | | | |
|---|---|---|---|
| 3,159,318 | 12/1964 | Green | 222/402.18 |
| 3,401,844 | 9/1968 | Hanson, Jr. | 239/308 X |
| 3,669,316 | 6/1972 | Corsette | 222/402.24 X |
| 3,862,741 | 1/1975 | Steiman et al. | 222/402.24 X |

FOREIGN PATENT DOCUMENTS

| | | | |
|---|---|---|---|
| 930,340 | 7/1973 | Canada | 222/402.21 |
| 747,379 | 4/1956 | United Kingdom | 222/402.24 |

*Primary Examiner*—Stanley H. Tollberg
*Assistant Examiner*—David A. Scherbel
*Attorney, Agent, or Firm*—Wenderoth, Lind & Ponack

[57] ABSTRACT

A dispenser for a butane aerosol dispenser. The dispenser has a hollow support, a dip tube depending from the central portion of the bottom of the support and opening into the interior of the support, the bottom surface of the support having at least one propellant inlet aperture at the periphery thereof. A pushbutton having a depending sleeve is positioned above the support with the lower end movable into and out of the support. A nozzle is provided in the pushbutton, the pushbutton having a supply passage from the interior of said sleeve to the nozzle. The support and sleeve have a mixture flow path therethrough and gasket in the flow path opens the flow path when the sleeve is moved into the support. An annular passage is provided along the flow path for expansion of the butane propellant as it passes along the flow path.

6 Claims, 3 Drawing Figures

AEROSOL DISPENSER USING BUTANE PROPELLANT

The present invention relates to a dispensing means for an aerosol dispenser, and more particularly to a dispensing means for such a dispenser which makes possible the use of butane as the propellant.

THE BACKGROUND OF THE INVENTION AND PRIOR ART

Aerosol type dispensers are well known, and they generally comprise a container containing the product to be dispensed in liquid form, and a propellant at least part of which is in the gaseous or vapor phase for exerting pressure on the liquid product for forcing the liquid product through a dip tube to a dispensing valve means mounted on the container. Upon actuation of the valve means to open the valve means, the liquid is forced through the valve means and is dispensed in the form of a spray, usually mixed with some of the propellant.

Heretofore, the propellants which have been used have been the so-called high pressure propellants, such as the fluorinated hydrocarbon known under the trademark Freon. These propellants are inert to a large number of products which it is desired to dispense from dispensers of this type, and have characteristics with respect to their vapor pressure and temperature which are advantageous for use as propellants for dispensing liquid products at ambient temperatures and with good spray patterns and droplet size.

However, one problem with the aerosol dispensers in which these propellants are used is that they must be built with sufficient strength to contain the high pressure gas, which is normally in the range of 90 to 100 psi. Pressures of this type have been necessary to keep the propellant in liquidified form in solution with the product and to provide a sufficient pressure for dispensing the product when the container is first filled and has a relatively small vapor space within the upper part of the container. Further, such pressures are necessary in order to insure that there is sufficient pressure in the container when the product is nearly exhausted to continue dispensing the product at the desired dispensing rate.

A second problem created by the relatively high pressure of the propellant is the problem of the safety of the containers. Because they contain such a high pressure, they must be handled carefully, particularly with respect to storage in high temperature locations, and because the pressure within the container is appreciable, even after all the product has been dispensed, special precautions must be taken in disposing of the containers to prevent explosion, for example, if they are incinerated.

Another problem which has recently arisen in connection with the use of Freon is the problem of the toxic and environmental effects of the Freon itself. It has recently been found that Freon can have serious effects on the respiratory reflexes, therefore making the product dangerous to inhale. This is a serious deficiency for products such as hair sprays and the like which are used in the vicinity of the nose and mouth. The environmental effect of the Freon has not yet been conclusively provided, but sufficient information is available to make packagers of products to be dispensed by dispensers of this type wary of the continued use of Freon as a propellant.

It has been speculated for some time that butane could be used as a low pressure type propellant, provided that the dispensing of products by means of butane can be controlled properly. However, the valve mechanism for controlling the dispensing of products with the high pressure propellants has been found to be unsatisfactory for the dispensing of a liquid product with butane as the propellant.

The art of aerosol type dispensers would be considerably advanced if a valve mechanism could be devised which could dispense a liquid product with butane as a propellant, since the container would then have to resist only a relatively low pressure on the order of 15–20 psi, and could accordingly be made somewhat less expensively, could be handled and shipped without danger, and could be disposed of without danger. Moreover, butane is not believed to have any environmental effects of the nature of those attributed to Freon.

OBJECTS AND BRIEF SUMMARY OF THE INVENTION

It is therefore an object of the present invention to provide a dispensing means for a butane aerosol dispenser.

It is a further object of the invention to provide such a dispensing means which utilizes a number of parts which are common in the art, and which can be easily made from plastic by conventional molding techniques.

It is a further object of the invention to provide such a dispensing means which has relatively few parts and can be made and assembled relatively inexpensively.

These objects are achieved by the provision of the dispensing means according to the invention which comprises a hollow support having an open top, a dip tube depending from the central portion of the bottom of the support and opening into the interior of the support, a plurality of propellant inlet apertures around the periphery of the bottom surface of the support, an annular gasket on the top of the support, a mounting cup having an inwardly extending flange over said annular gasket and holding said gasket in sealing engagement against the top of the support, said mounting cup being crimped into engagement with said support, a pushbutton having a depending sleeve with the lower end engaged with the inner periphery of said annular gasket, said pushbutton having a cavity therein and a nozzle insert in said cavity having an axial outlet passage and at least one transverse passage opening into said axial passage, said pushbutton having a supply chamber at the periphery of said nozzle insert from which said transverse passage extends, and a supply passage from the interior of said sleeve into said supply chamber, a solid stem extending from within said support into said sleeve and guided in said support for movement in the direction of the axis of said support and having a flange thereon with a lip around the periphery thereof for engaging the underside of said gasket in sealing relationship, and spring means in said support engaging said flange on said stem for urging said sleeve upwardly into said stem, the diameter of said stem in said support being less than the internal diameter of the hollow interior of the support, and the diameter of said stem in said sleeve being slightly less than said sleeve to define an annular passage between said stem and said sleeve.

BRIEF DESCRIPTION OF THE FIGURES

The invention will now be described in greater detail in connection with the accompanying drawings, in which.

DETAILED DESCRIPTION OF THE INVENTION

Figure 1:
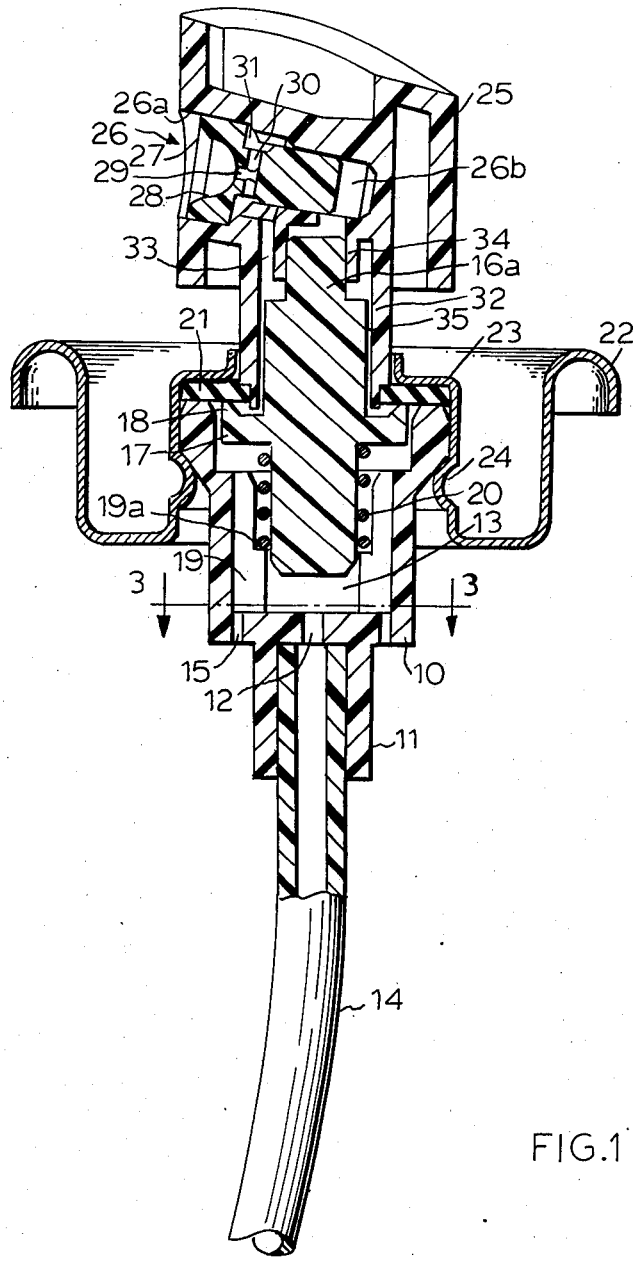
FIG. 1 is a sectional elevational view of the dispensing means according to the invention with the parts in the rest or non-dispensing positions.

As seen in the figures, the dispensing means according the invention comprises a hollow support 10 having an open top. A support sleeve 11 depends from the center of the bottom of the support 10, and an axial product inlet aperture 12 opens into the hollow interior 13 of the support 10 from the interior of the sleeve 11. A dip tube 14 is tightly fitted into the sleeve 11 for conducting product from the bottom of a product container (not shown) to the inlet aperture 12.

Figure 3:
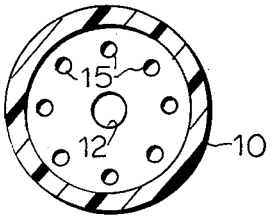
FIG. 3 is a section taken on line 3—3 of FIG. 1.

Around the periphery of the bottom surface of the support 10 is a plurality of butane propellant inlet apertures 15. As seen in FIG. 3, these apertures are preferably evenly spaced around the periphery of the support 10, and preferably they must together have a cross-sectional area at least equal to the area of the axial product inlet aperture 12. While a plurality of apertures 15 are shown, it has been found that a single such aperture will produce acceptable results, provided it is substantially the same size as the product inlet aperture 12.

Within the hollow interior 13 of the support 10 is a solid stem 16 having a flange 17 intermediate the length thereof with a gasket engaging lip 18 projecting from the upper surface of the outer edge of the periphery of the flange 17. The lower end of the stem 16 is guided for vertical movement in the hollow interior 13 by guide ribs 19 spaced around the periphery of the hollow interior 13. A spring 20 around the lower portion of the stem 16 engages between a ledge **19*a* on the ribs and the underside of the flange 17 to urge the solid stem 16** upwardly.

An annular gasket 21 rests on the top of the hollow support 10, and is made of rubber, or the like, so as to be flexible. The gasket engaging lip 18 is urged against the underside of the gasket 21 in sealing relationship therewith by the spring 20. A mounting cup 22 is provided for mounting on the open top of the container, and the mounting cup 22 has an inwardly extending flange on the inner periphery thereof positioned over the gasket 21. The mounting cup 22 is crimped to the support 10 by an inwardly extending annular deformation 24 which is crimped under an outwardly extending portion of the support 10.

A pushbutton 25 is positioned over the upper end of the stem 16. The pushbutton 25 has a cavity 26 therein with a large diameter portion **26*a* at the outer end of the cavity 26 and a smaller diameter portion 26*b* at the inner end of the cavity 26. Positioned in the cavity 26 is a nozzle insert 27 having a larger diameter portion fitting into the larger diameter portion 26*a* of the cavity 26, and a smaller diameter portion fitting into the smaller diameter portion 26*b* of the cavity 26. The outer end of the nozzle insert 27 has a diverging portion 28 into the center of which opens an annular outlet passage 29. Opening into the outlet passage 29 from the periphery of the nozzle insert 17 are transverse passages 30**.

The portion of the nozzle insert between the larger diameter portion and the smaller diameter portion is shaped so as to leave between the nozzle insert and the interior of the recess 26 an annular supply chamber 31 into which the transverse passages 30 extend.

Depending from the pushbuttom 25 is a depending sleeve 32. A supply passage 33 extends from the inner end of the interior of the sleeve 32 into the supply chamber 31. The lower end of the depending sleeve 32 is notched so as to fit over the inner periphery of the annular gasket 21. Within the inner end of the depending sleeve 32 is a socket 34 into which the upper end of the stem 16 is tightly fitted to hold the pushbutton 25 on the stem 16.

The diameter of the upper portion of the stem 16 is slightly less than the inside diameter of the depending sleeve 32, so as to leave between the stem 16 and the sleeve 32 an annular expansion passage 35 extending from the bottom of the sleeve 32 along the upper portion of the stem 16 to substantially the entrance of the supply passage 33. A reduced diameter upper portion **16*a* is provided to fit into the socket 34 so as to leave an annular space around the smaller diameter portion 16*a* to permit gaseous material from the expansion passage 35 to flow around the reduced diameter portion 16*a* to the supply passage 33**.

With the parts in the position as shown in FIG. 1, the gasket engaging lip 18 engages the underside of the annular gasket 21, which in turn is held in sealing engagement with the upper edge of the support 10, thereby sealing the interior of the container on which the mounting cup 22 is mounted from the outside atmosphere.

It will thus be seen that the hollow interior 13 of the support 10, the interior of the sleeve 32 and supply passage 33 constitute a flow path for a mixture of butane propellant and the product to be dispensed from the bottom of support 10 to the nozzle insert 27, and that the gasket 21 blocks this flow path when in the rest position. The annular expansion passage 35 is in this flow path.

Figure 2:
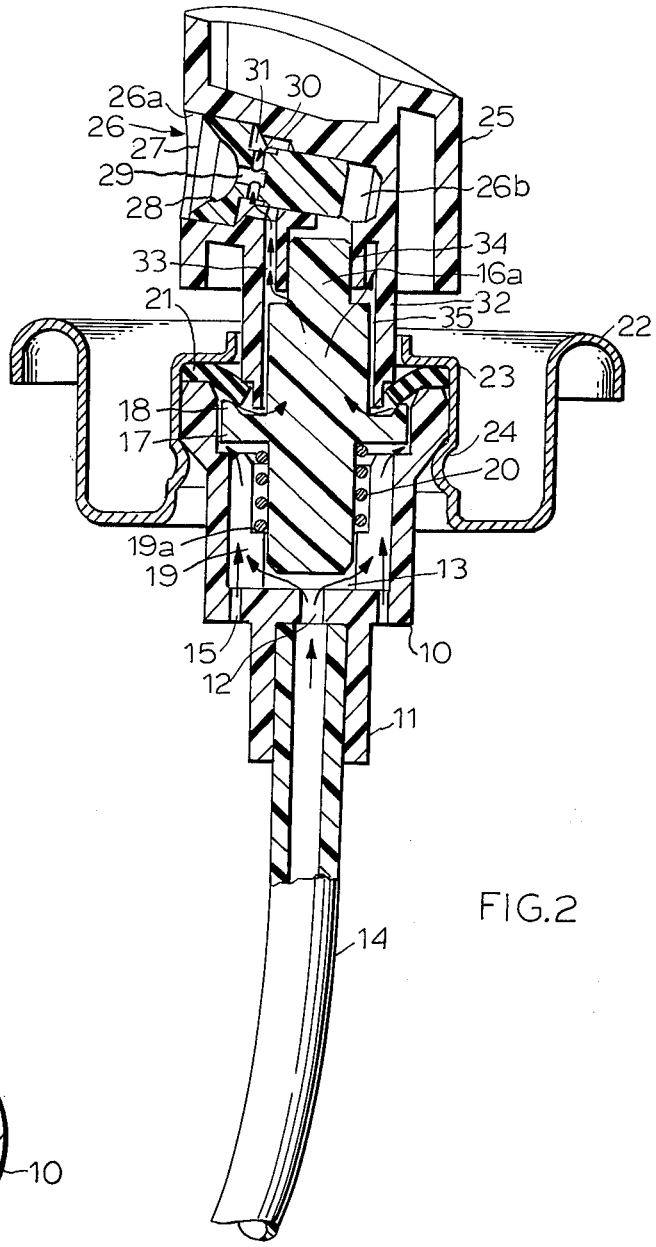
FIG. 2 is a view similar to FIG. 1 with the parts in the dispensing positions.

When the pushbutton 25 is depressed against the force of the spring 20, the parts are moved to the positions shown in FIG. 2. As indicated by the arrows in FIG. 2, the liquid product in the container is forced, by the pressure of the butane in the space above the liquid in the container, up the dip tube 14 through the axial product inlet aperture 12 into the hollow interior 13 of the support 10. At the same time, gaseous butane is admitted through the butane propellant apertures 15 into the hollow interior 13 of the support 10. The liquid product and the gaseous propellant mix in this hollow interior, and the mixture flows upwardly along the flow path for the mixture, i.e. around the periphery of the flange 17, through the space now left between the gasket engaging lip 18 and the underside of the annular gasket 21, and through the annular expansion passage 35 to the supply passage 33. Because of the configuration of this flow path, and particularly the annular expansion passage, the expansion of the butane propellant is made gradual, so that by the time it reaches the supply passage 33, it has undergone substantially complete expansion. The propellant and product now thoroughly mixed, flow through supply passage 33 into the annular supply chamber 31, through the transverse passages 30 and are discharged from the axial outlet passage 29 in the form of a spray of fine droplets of liquid product in the gaseous butane.

It has been found from experiments that it is only the combination of the peripheral propellant inlet aperture 15 in the bottom surface of the support 10, with the central product inlet aperture 12, and the annular expansion passage 35 which together produce a proper control of the expansion of the butane so as to result in an acceptable spray pattern and droplet size. The use of a plurality of peripheral propellant inlet apertures 15 gives the best results.

It has been determined that the size of the butane propellant inlet aperture or apertures 15 and the size of the axial product inlet aperture 12 should be on the order of 0.032 in. in diameter, while the annular expansion passage should have an outside diameter of approximately 0.230 in. and an inside diameter of approximately 0.228 – 0.220 in. for butane propellant on the order of 16 psi.

It will be seen that the foregoing structure makes use of a large number of parts which are conventional in the art, for example, the nozzle insert 27, the pushbutton 25, the support 10, etc. Moveover, all these parts can be easily molded in plastic, and there is a minimum number of parts, i.e. seven parts, all except the annular gasket 21 and spring 20 which can be molded of plastic. All of the parts can be easily incorporated in the mounting cup 22, which is also a common type of cup, well known in the art. Because of the relatively few number of parts, and the fact that the parts can substantially all be molded of plastic, the dispensing device can be made and assembled relatively inexpensively.

Because the device can dispense a liquid product by the use of butane as a propellant, it makes possible the overcoming of the problems of the so-called high-pressure dispensers, and makes possible the use of low-pressure propellant, which is far safer, both from the standpoint of the safety of the container for the propellant and product during use, storage, and disposal, and also from the standpoint of the environmental effects of the butane propellant itself.

What is claimed is:

1. A dispensing means for a butane aerosol dispenser, comprising a hollow support, a dip tube depending from the central portion of the bottom of the support and opening into the interior of the support, the bottom surface of said support having at lease one propellant inlet aperture at the periphery thereof, a pushbutton having a depending sleeve with the lower end movable into and out of the support, nozzle means in said pushbutton, said pushbutton having a supply passage from the interior of said sleeve to said nozzle means, said support and sleeve having a mixture flow path therethrough and gasket means in said flow path for opening said flow path when said sleeve is moved into said support, and annular passage defining means along said flow path in said support and sleeve for defining an elongated annular passage for expansion of the butane propellant as it passes along said flow path.

2. A dispensing means for a butane aerosol dispenser, comprising a hollow support having an open top, a dip tube depending from the central portion of the bottom of the support and opening into the interior of the support, the bottom surface of said support having at least one propellant inlet aperture at the periphery thereof, an annular gasket on the top of the support, a mounting cup having an inwardly extending flange over said annular gasket and holding said gasket in sealing engagement against the top of the support, said mounting cup being crimped into engagement with said support, a pushbuttom having a depending sleeve with the lower end engaged with the inner periphery of said annular gasket, said pushbutton having a cavity therein and a nozzle insert in said cavity having an axial outlet passage and at least one transverse passage opening into said axial passage, said pushbutton having a supply chamber at the periphery of said nozzle insert from which said transverse passage extends, and a supply passage from the interior of said sleeve into said supply chamber, a solid stem extending from within said support into said sleeve and guided in said support for movement in the direction of the axis of said support, and having a flange thereon with a lip around the periphery thereof for engaging the underside of said gasket in sealing relationship, and spring means in said support engaging said flange on said stem for urging said stem upwardly into said sleeve, the diameter of said stem in said support being less than the internal diameter of the hollow interior of the support, and the diameter of said stem in said sleeve being slightly less than said sleeve to define an elongated annular passage between said stem and said sleeve.

3. A dispensing means as claimed in claim 2 in which said support has a plurality of propellant inlet apertures evenly spaced around the bottom surface thereof.

4. A dispensing means as claimed in claim 3 in which the total cross-sectional area of the propellant inlet apertures is substantially equal to the cross-sectional area of the opening from the dip tube into the support.

5. A dispensing means as claimed in claim 2 in which the cross-sectional area of the propellant inlet aperture is substantially equal to the cross-sectional area of the opening from the dip tube into the support.

6. Dispensing means for a butane aerosol dispenser, comprising a hollow support having an open top, a dip tube depending from the central portion of the bottom of the support and opening into the interior of the support, the bottom surface of said support having at least one propellant inlet aperture at the periphery thereof, an annular gasket mounted in sealing engagement on the top of the support, a pushbutton having a depending sleeve with the lower end engaged with the inner periphery of said annular gasket, nozzle means in said pushbutton opening out of said pushbutton from the interior of said sleeve, a solid stem extending from within said support into said sleeve and guided in said support for movement in the direction of the axis of said support, and having a flange thereon with a lip around the periphery thereof for engaging the under side of said gasket in sealing relationship, and spring means in said support engaging said flange on said stem for urging said stem upwardly into said sleeve, the diameter of said stem in said support being less than the internal diameter of the hollow interior of the support, and the diameter of said stem in said sleeve being slightly less than said sleeve to define an elongated annular passage between said stem and said sleeve for expansion of the butane propellant as it passes along said elongated annular passage.

* * * * *